United States Patent [19]

LaSpisa et al.

[11] Patent Number: 4,742,783

[45] Date of Patent: May 10, 1988

[54] INCINERATOR COMBUSTION AIR CONTROL

[75] Inventors: Ronald J. LaSpisa; Thomas J. Hubbard; Merle R. Likins, Jr. all of Bartlesville, Okla.

[73] Assignee: Phillips Petroleum Company, Bartlesville, Okla.

[21] Appl. No.: 82,153

[22] Filed: Aug. 6, 1987

[51] Int. Cl.[4] ..... F23N 5/18

[52] U.S. Cl. ..... 110/188; 110/212; 110/214; 110/346; 236/15 BD; 236/15 E; 431/12; 431/76

[58] Field of Search ..... 110/185, 186, 187, 188, 110/203, 210, 212, 214, 101 C, 101 CF, 346; 122/449; 236/15 BD, 15 E; 431/12, 76

[56] References Cited

U.S. PATENT DOCUMENTS

| | | | |
|---|---|---|---|
| 3,607,117 | 9/1971 | Shaw et al. | 431/12 X |
| 3,734,675 | 5/1973 | Osbarn | 431/12 |
| 4,013,023 | 3/1977 | Lombana et al. | 110/187 |
| 4,279,208 | 7/1981 | Guillame et al. | 431/76 X |
| 4,320,709 | 3/1982 | Hladun | 110/235 |
| 4,330,260 | 5/1982 | Jorgensen et al. | 431/12 |
| 4,332,206 | 6/1982 | Tucker et al. | 110/203 |
| 4,517,906 | 5/1985 | Lewis et al. | 110/187 X |
| 4,520,741 | 6/1985 | Carbeau et al. | 110/344 |
| 4,557,686 | 12/1985 | LaSpisa | 431/12 |

*Primary Examiner*—Steven E. Warner

*Attorney, Agent, or Firm*—Williams, Phillips & Umphlett

[57] ABSTRACT

For continuous combustion air control in a hazardous waste incinerator, two signals are generated which totalize the air required on a fuel supplied basis. One signal is responsive to measured totalized fuel flow and this total can include fuel flow signals which are limited to the fraction of available air which corresponds to the fuel flow. The other signal is responsive to the totalized fuel flow that is commanded for maintaining an incinerator condition. In use the signal which requires the greater air flow is selected as the actual control signal for combustion air, and this control signal is biased to increase the air flow to obtain complete combustion of the hazardous waste by a controller acting on the measured amount of oxygen in the flue gas. In this manner the combustion air is manipulated in parallel with the waste fuel and if the fuel flow is limited by the available air, the air flow is limited to match the limited fuel flow.

20 Claims, 4 Drawing Sheets

INCINERATOR COMBUSTION AIR CONTROL

This invention relates to incineration of hazardous waste material. In one aspect it relates to apparatus for controlling combustion air supplied to an incinerator. In another aspect it relates to a method for automatically manipulating combustion air supplied to a hazardous waste incinerator so as to maintain an air supply of ample proportions as required under State and/or Federal regulations for the particular waste being burned.

BACKGROUND OF THE INVENTION

Incineration is a process used to burn waste substances in which all of the combustion factors, i.e. temperature, retention time, turbulence, and air supply, can be controlled. One of the basic requirements for incineration is therefore to maintain an air supply in the incinerator that is sufficient for waste destruction.

Due to an increase in environmental awareness and a decrease in available sites for land-fill operations, incineration systems are playing an increasing role in the field of waste management. The use of incineration systems is especially preferred in the disposal of various hazardous wastes. However, incineration of hazardous waste material inherently poses a serious threat to environmental concerns, and is therefore regulated by State and Federal agencies. These regulations require complete combustion of the hazardous waste in order to effect control of emissions released to the atmosphere. It is thus necessary that computer systems be developed which can closely monitor and control the waste destruction process to insure that complete combustion of the hazardous waste material has taken place, and which can respond rapidly to compensate for upsets that can occur in the combustion process.

Accordingly, it is a primary object of this invention to provide a method and apparatus for controlling the combustion air supplied to an incinerator that burns multiple waste fuels and where each waste fuel has a different theoretical air to fuel ratio. Another object of this invention is to control the combustion air so as to maintain a desired quantity of excess oxygen in the combustion gases of an incinerator that burns multiple waste fuels. It is a further object of this invention to provide the required quantity of air for complete combustion of hazardous waste material under regulations such as specified by the Federal Resources Conservation and Recovery Act (RCRA) for industrial waste disposal.

SUMMARY OF THE INVENTION

In accordance with one aspect of the present invention, method and apparatus are provided for automatically controlling the flow rate of multiple combustion air streams to an incinerator. The flow of combustion air to the incinerator is controlled in response to the fuel flow so as to automatically provide the oxygen required for complete combustion of the waste fuels burned in the incinerator. The quantity of excess oxygen included in the combustion air, which is dependent, for example, on waste fuel properties and the fuel burning equipment utilized, is maintained at a value specified by the regulating agency for an analyzed batch of waste. In addition, if the fuel flow is limited by the available air supply, the air flow is limited to match the limited fuel flow.

The theoretical air to fuel ratio for each waste fuel stream and each auxiliary fuel stream is predetermined by the operator based on elemental analysis of the fuels. Next two signals representative of the theoretical incinerator air supply required for combustion of all waste components are established. A first signal is established by multiplying the actual flow rate of each fuel, which can be representative of an air limited flow rate, by its respective theoretical air to fuel ratio to determine the theoretical air requirement for each fuel, and then summing the theoretical air requirement for all fuels supplied to the incinerator. A second signal for the required incinerator air supply is established by multiplying the "commanded" flow rate of each fuel by its respective theoretical air to fuel ratio, and again summing the theoretical air requirements for all fuels supplied to the incinerator. As used herein commanded fuel flow rate is the maximum flow rate for that particular fuel that can be supplied to the incinerator to maintain an incinerator operating condition.

Normally the commanded fuel flow rate will be equal to the actual fuel flow rate. However, it is noted that the commanded fuel flow rate could change during a burn. For example, if a high incinerator temperature limit is approached the commanded fuel flow rate would be decreased. For a decreasing commanded fuel flow rate the actual fuel flow rate will at least temporarily be greater than the commanded flow rate. Conversely for an increasing commanded flow rate the commanded flow rate will at least temporarily be greater than the actual flow rate.

The high signal select of these two signals, each of which typifies the total theoretical air required for combustion of all waste components, is the control signal for combustion air. This selected control signal is then biased by a signal, which typifies an excess oxygen factor for trimming the theoretical air supply control signal. This trim factor indicates the increase in the magnitude of the theoretical air control signal that is required for complete combustion of all waste fuel supplied to the incinerator. This biased control signal is provided, after a split-range division, as set point signals to controllers for primary and secondary air.

The combustion air provided to the incinerator is thus regulated with respect to the greater flow of waste fuel represented by the actual measured fuel flow and the commanded fuel flow. This scheme manipulates the air supply to the incinerator in parallel with the fuel supply and provides sufficient oxygen to completely combust the waste fuel at all times, e.g. even when the flow rate of waste fuel is increasing or decreasing.

Additional objects and advantages of the invention will be apparent from the following description and of a preferred embodiment of the invention as illustrated by the drawings in which.

DESCRIPTION OF THE PREFERRED EMBODIMENT

The invention is illustrated and described in terms of a rotary kiln type incinerator which accepts waste in liquid or gaseous form and also accepts an auxiliary fuel stream which is typically natural gas or fuel oil. The incinerator also includes an afterburner which insures complete combustion of exhaust gases from the kiln and in addition the afterburner accepts a liquid or gaseous waste fuel and the auxiliary fuel.

Although the invention is described in terms of a rotary kiln type incinerator with an afterburner and having three conduits for supplying waste material, the applicability of the invention extends to any other type of incinerator which must control the combustion air supply to insure complete combustion of hazardous waste material. The invention is not limited by the number of waste material streams supplied to the incinerator. Some pertinent incineration processes in addition to the described rotary kiln process include liquid injection processes, fluidized bed processes, etc.

Figure 1:
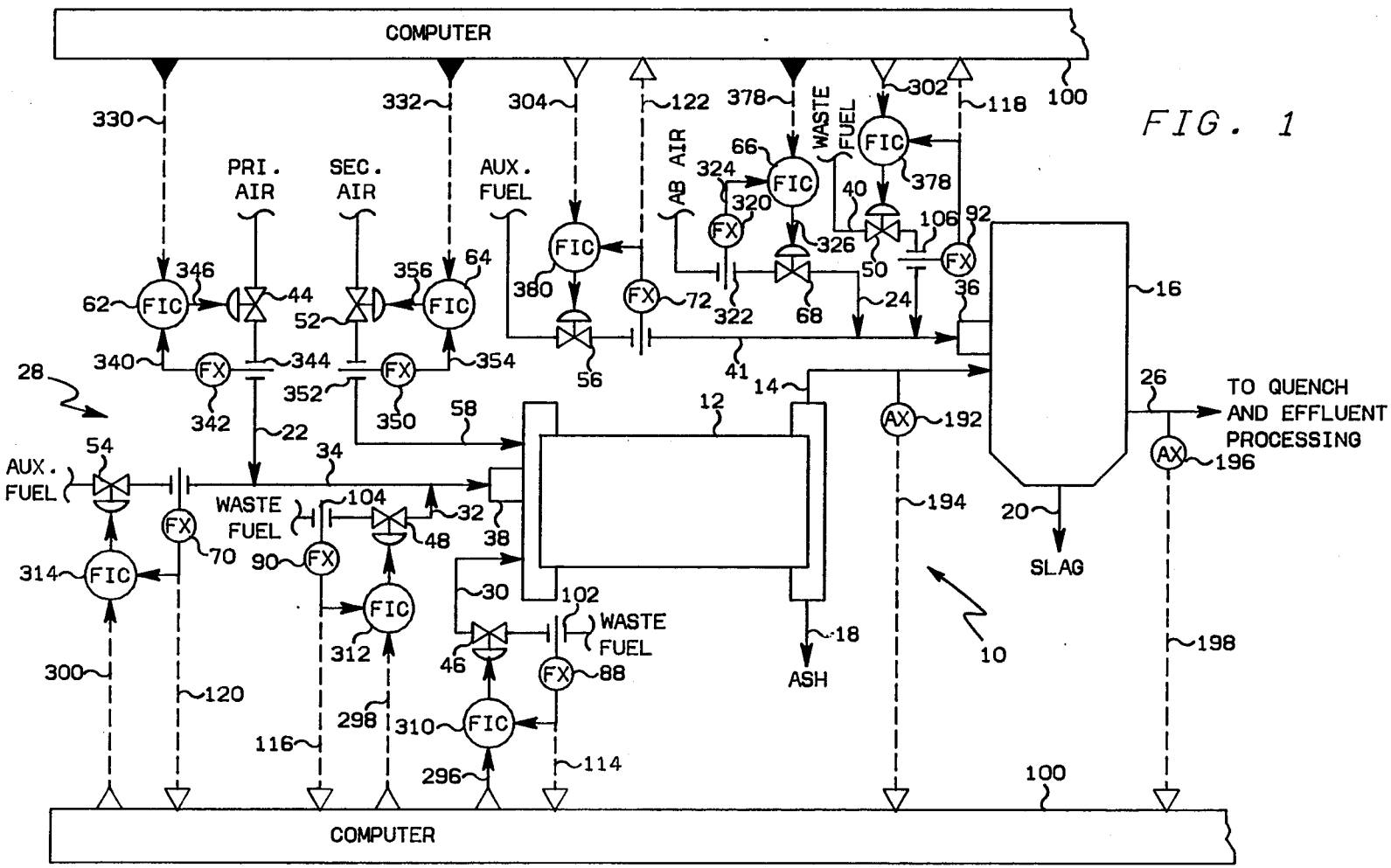
FIG. 1 is a diagrammatic illustration of an incinerator with its associated combustion air control system.

Only those portions of the incinerator control system necessary to illustrate the present invention are illustrated in FIG. 1. A large number of additional control devices will be utilized to control an incinerator, but these additional control devices have not been illustrated for the sake of clarity in illustrating the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals associated with any computer or any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combinations of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as data supplied to the computer. Analog computers or other types of computing devices could also be used in the invention. The digital computer is preferably an OPTROL® DCS Process Computer System from Applied Automation, Inc., Bartlesville, Okla.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a sealed output signal, representative of a comparison of the two input signals, is within the scope of the invention. The operation of proportional-integral-derivative controllers is well known in the art. The output control signal of a proportional-integral-derivative controller may be represented as $$S=K_1E+K_2\int Edt+K_3dE/dt$$

where

S=output control signals;

E=difference between two input signals; and $K_1$, $K_2$ and $K_3$=constants.

The scaling of an output signal by a controller is well known in control systems art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more of such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1 there is illustrated an incinerator generally designated at 10 which comprises a feed system generally indicated at 28, a rotary kiln 12, a kiln combustion products transfer duct 14, an afterburner 16, and an afterburner combustion product transfer duct 26. The rotary kiln 12, which is mounted at a slight incline from the horizontal plane, transfers its combustion gases through duct means 14 to the afterburner 16 to insure complete combustion of waste material prior to treatment for air pollutants. The bottom ash that remains in the kiln 12 after a material is incinerated is removed through ash duct 18. The slag formed in afterburner 16 is removed through duct 20. Combustion gases from the afterburner 16 are transferred through duct means 26 for further processing which can include quenching, scrubbing, separating, etc.

The feed system supplies hazardous/toxic waste to be burned in the incinerator through a plurality of fluid conduit means which can be equipped with waste burners if desired. Generally, hazardous liquid or gaseous waste material is analyzed at least for composition, and based on elemental analysis a determination of the theoretical air required for complete combustion is made. The waste is then stored in bulk storage tanks, not shown in FIG. 1, according to the analysis. The preanalyzed material is then supplied to the kiln 12 from bulk storage tanks, not shown, through conduit means 30 or 32, or is supplied to the afterburner through conduit means 40. The term waste fuel as used in this specification means the hazardous waste material to be destroyed.

The hazardous waste material supplied through control valve 46 operably located in conduit means 30 is typically a low BTU waste fuel pumped to the kiln 12 from a bulk storage tank, not shown. The hazardous waste material supplied to the kiln 12 through control valve 48 operably located in conduit means 32, and which can also be supplied to the afterburner 16 through control valve 50 operably located in conduit means 40 is typically an organic material having a high BTU content. It is supplied to the multi-fuel burner 38 associated with the kiln 12, and the multi-fuel burner 36 associated with the afterburner 16 where it is mixed with primary air supplied to the kiln through conduit means 22, and to the afterburner through conduit means 24. As previously stated burners 36 and 38 are multi-fuel burners which means liquid fuel, gaseous fuel and vaporous fuel can be supplied to burners 36 and 38.

An auxiliary fuel such as natural gas or fuel oil is also supplied to the burner 38 and the burner 36 through control valves 54 and 56 respectively which are located in conduit means 34 and 41 respectively. Secondary combustion air is also supplied to the kiln 12 through control valve 52 which is operably located in conduit means 58.

As illustrated in FIG. 1 various control valves are utilized to manipulate the flow of combustion air to the kiln 12 and the afterburner 16 as required for control of the incinerator. As will be described more fully hereinafter oxygen content of the combustion products of the kiln and the afterburner are controlled by manipulating the flow rate of the combustion air supplied to the kiln and the afterburner.

Figure 2:
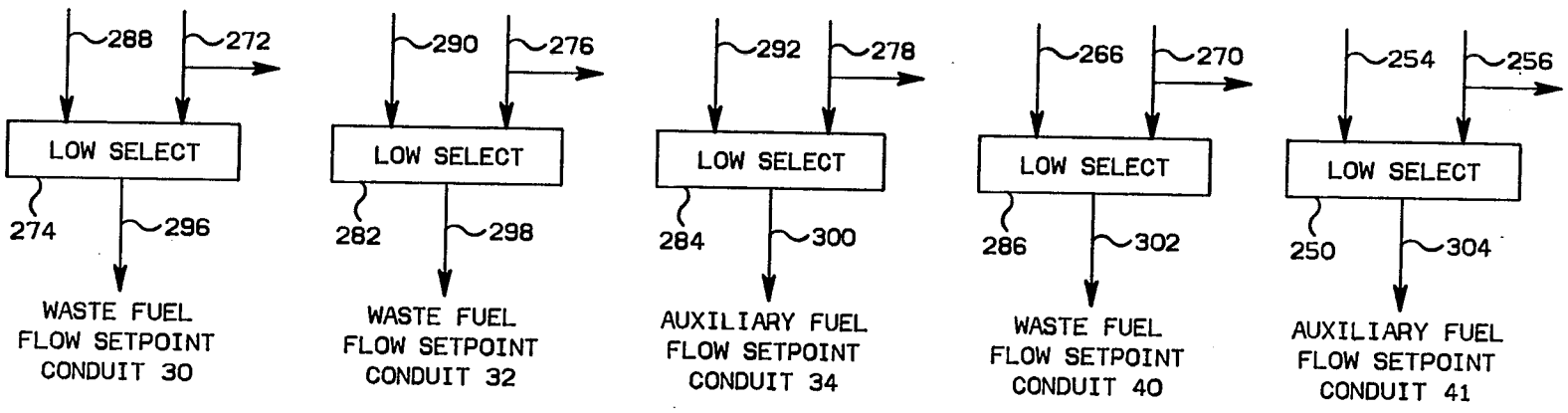
FIG. 2 is a block diagram illustrating selection of signals utilized to control fuel flow supplied to the incinerator.
Figure 3:
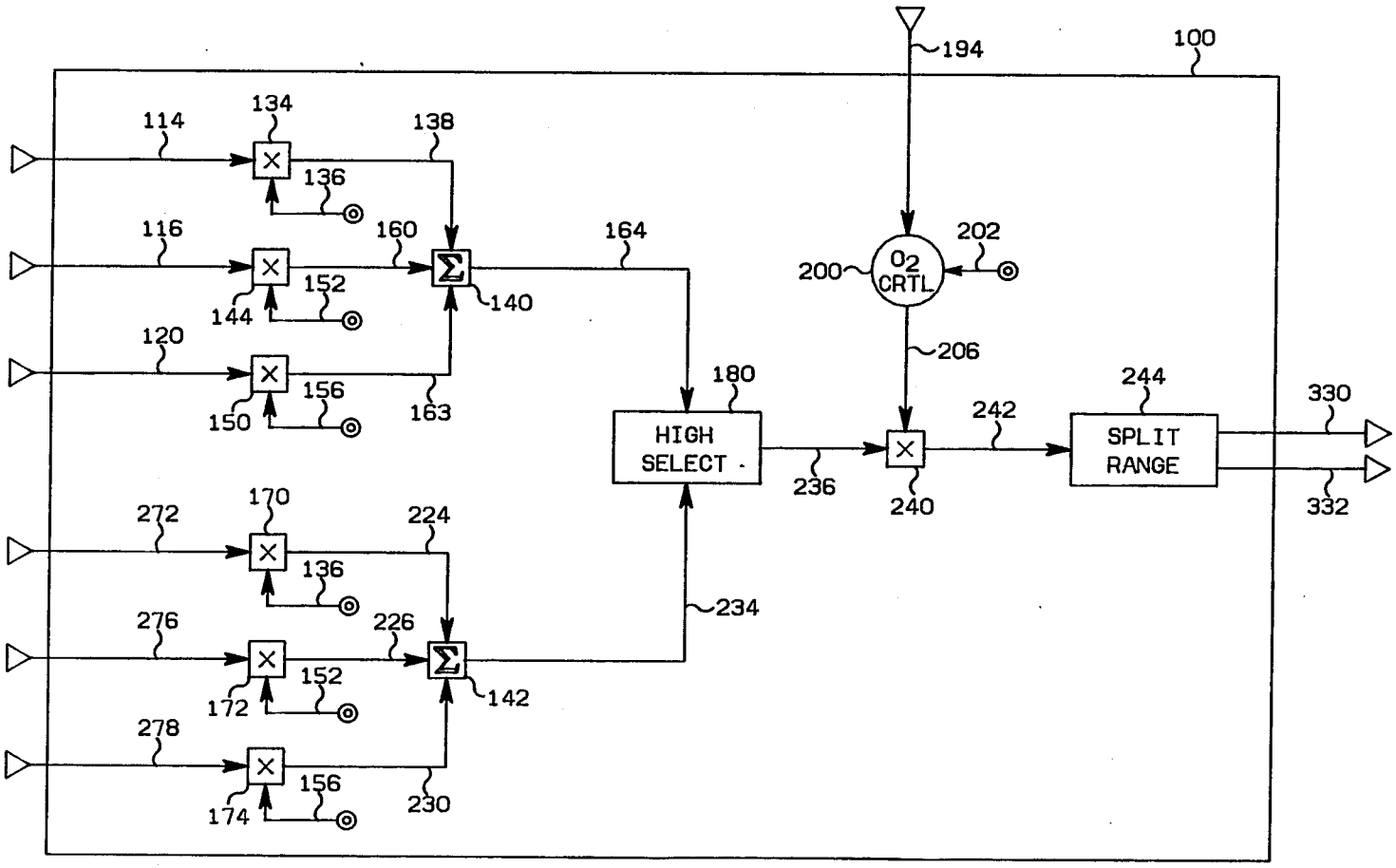
FIG. 3 is a block diagram of the preferred computer logic utilized to calculate set points for primary and secondary air flow controllers for the kiln.
Figure 4:
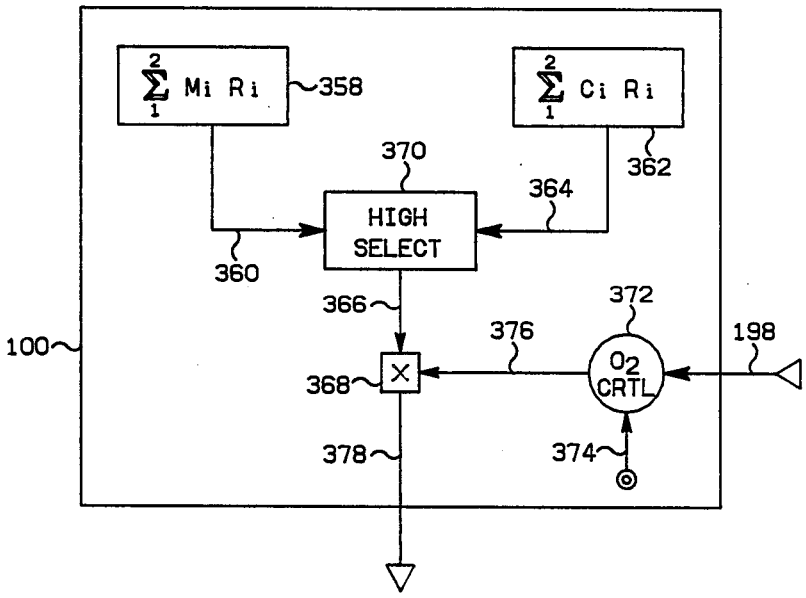
FIG. 4 is a block diagram of the preferred computer logic utilized to calculate the set point for the afterburner air flow controller.

The process measurements utilized to generate the set point signals for controllers 62, 64 and 66 are illustrated in FIG. 1. The manner in which the process measurements are combined to generate the required control signals is illustrated in FIGS. 2–4. The process measurement will first be described, thereafter the manner in which the process measurements are utilized to generate the control signals will be described.

Flow transducer 88 in combination with flow sensor 102 which is operably located in conduit means 30 provides an output signal 114 which is representative of the actual flow rate of waste fuel through conduit means 30. Signal 114 is provided from the flow transducer 88 as an input to computer 100. In like manner flow transducers 90, and 92, in combination respectively with flow sensors 104 and 106, which are operably located in conduit means 32, and 40 respectively and which respectively provide output signals 116 and 118, which are representative of the respective actual flow rates of waste fuel in conduit means 32 and 40. Both of the flow signals are provided as inputs to computer 100.

Analyzer transducer 192 which is an oxygen analyzer operably located in conduit means 14 provides an output signal 194 which is representative of the percent oxygen content of the combustion gases exiting the kiln 12. Signal 194 is provided from analyzer transducer 192 as an input to computer 100. In like manner analyzer transducer 196 which is an oxygen analyzer operably located in conduit means 26 provides an output signal 198 which is representative of percent oxygen content of the combustion gases exiting the afterburner 16. Signal 198 is provided from analyzer transducer 196 as an input to computer 100.

In response to the aforementioned process variables, the predetermined waste fuel analysis, and in response to oxygen level set points determined by the regulating agency for the particular type of hazardous waste being burned, the computer 100 provides three (3) control signals to manipulate combustion air to the incinerator as will be more fully described hereinafter.

Referring now to FIG. 3, signal 114 which is representative of the actual flow rate of waste fuel flowing in conduit means 30 is provided to multiplying block 134. Signal 136 which is an operated entered input representative of the predetermined theoretical air to fuel ratio of the waste fuel flowing at conduit means 30 is provided as a second input to multiplying block 134. Signal 136 is multiplied by signal 114 to establish signal 138 which is representative of the theoretical air flow required for the combustion of the waste fuel flowing in conduit means 30. Signal 138 is provided to summing block 140.

In a similar manner signals representative of the theoretical air flow required for each fuel supplied to the kiln are provided to summing blocks as illustrated in FIG. 3. In particular, signals 116 and 120 which are representative of the actual flow rates in conduit means 32, and 34 respectively are multiplied by signals 152 and 156 which are operator entered signals representative of the respective predetermined air to fuel ratios for the fluids flowing in conduit means 32 and 34 to provide the respective air flow signals 160 and 163 from multiplying blocks 144 and 150 respectively.

Signals 138, 160 and 163 are summed in summation block 140 to establish signal 164 which is representative of the total theoretical air flow required for combustion of all fuel supplied to the kiln based on the actual (measured) fuel flow rates. Signal 164 is provided from summation block 140 as a first input to high select block 180. High select block 180 is also provided with signal 234 which is representative of the total theoretical air flow for complete combustion of all fuels supplied to the kiln based on the commanded fuel flow rates as will be described more fully below.

Referring now to FIG. 2, there is illustrated the selection of signals which represent the desired fuel flow rate for each fuel supplied to the incinerator. Signal 296 which is representative of the desired flow rate of waste fuel flowing in conduit means 30 is provided from low select block 274 as a set point input to flow controller 310 illustrated in FIG. 1. As shown in FIG. 2 signal 296 is selected as the lower one of signals 272 and 288 which are both representative of a flow rate for the waste fuel flowing in conduit means 30. Signal 272 and 288 will generally be known since typically they are provided from an associated combustion fuel flow control system.

For example signal 272 will typically be representative of a fuel flow rate for the waste fuel flowing in conduit means 30 required to prevent the incinerator from violating a particular constraint such as a maximum temperature, maximum pressure, or maximum heat release rate. Signal 272 is referred to as a "command" signal. As has been previously stated a command signal is a signal representative of the maximum flow rate of a fuel that can be provided to maintain an incinerator operating condition.

In contrast signal 288 is an air limiting signal, representative of the portion of the actual air flow in the kiln 12 available for combustion of the fuel flowing in conduit means 30. If signal 288 is selected for signal 296, the fuel flow through conduit means 30 is manipulated in response to the limited air flow which corresponds to the fraction of the total fuel that is supplied through conduit means 30. This condition creates a cross-limiting where the fuel flow in conduit means 30 is limited by the total available air, and the air flow is limited to match the limited fuel flow.

The limiting air flow signal for each waste fuel and the auxiliary fuel to the kiln are given by the general equation:

$$Ai = \left( M_iR_i / \sum_1^3 M_iR_i \right) AF/(R_iO_{2E})$$

where:

M=Measured Fuel Flow Rate (lbs./hr.),
R=Predetermined air to fuel ratio,
$O_{2E}$=Predetermined excess oxygen factor,
AF=Measured air flow, (lbs./hr.), and
i=Fuel index
1=conduit 30
2=conduit 32
3=conduit 34

The kiln air flow can be measured by any suitable means, for example, by summing air flows indicated by flow meters, not shown in the drawings, for primary and secondary air supplied to the kiln. Signal 272 is also provided from low select block 274 as an input to multiplying block 170 illustrated in FIG. 3.

In a similar manner, signals 298 and 300 which are representative of the desired fuel flow rates for fuel flowing in conduit means 32 and 34 respectively are provided from low select blocks 282 and 284 respectively as set point inputs to flow controllers 312 and 314 respectively. As illustrated in FIG. 2 signals 276 and 278 which like signal 272 are fuel command signals are also provided as inputs to multiplying blocks 172 and 174 respectively illustrated in FIG. 3. Signals 290 and 292 illustrated in FIG. 2 are air limiting signals which, like signal 288 can be selected for control signals over their corresponding command signals if there is insufficient air available.

Signal 136 which, as previously indicated, is representative of the air to fuel ratio of the waste fuel flowing in conduit means 30 is multiplied in multiplying block 170 by signal 272 to establish signal 224 which is representative of the theoretical air flow required to combust the fuel that could be supplied to the kiln 12 through conduit means 30 in response to fuel command signal 272. In a similar manner signals 152 and 156 are multiplied by signals 276 and 278 respectively in multiplying blocks 172 and 174 respectively to establish signals 266 and 230 respectively which are representative of the air flow required to completely combust the fuel supplied to the kiln through conduit means 32 and 34 respectively in response to their corresponding fuel command signals.

Signals 224, 226 and 230 are summed in summation block 142 to establish signal 234 which is representative of the total theoretical air flow required for complete combustion of all fuel supplied to the kiln based on fuel commanded flow rates. Signal 234 is provided from summation block 142 as a second input to high select block 180.

In response to signals 164 and 234 high select block 180 provides an output signal 236 which is representative of the highest flow rate represented by signals 164 and 234. Signal 236 is provided from high select block 180 as a first input to multiplying block 240.

Signal 194 which is representative of the percent oxygen content of combustion gases exiting the kiln 12 is provided as a process variable input to oxygen controller 200. Signal 202, which is representative of the desired excess oxygen for the kiln combustion gases is provided as a set point signal for oxygen controller 200. Oxygen controller 200 provides an output signal 206 which is representative of the difference between signals 194 and 202, and which is scaled so as to be representative of an excess oxygen factor required to bias or trim the total theoretical air flow signal 236 so that the actual excess oxygen in the kiln combustion gases is substantially equal to the excess oxygen represented by set point signal 202. Thus the excess oxygen factor indicates the increase in the magnitude of signal 236 required to obtain the air flow for complete combustion of waste fuel in the kiln 12. Signal 206 is provided from oxygen controller 200 as a second input to multiplying block 240. Signal 206 is multiplied by signal 236 in multiplying block 240 to establish signal 242 which is representative of the desired air flow for the kiln 12. Signal 242 is provided from multiplying block 240 as an input to the split-range computer block 244. As is well-known to those skilled in control systems art, in a split range control system the full scale output of a control signal is divided to operate over two or more portions of its full range so that different portions of the control signal can operate different valves or other final control devices.

In practice of the present invention the full scale range of signal 242 is divided into two portions such that the lesser magnitude portion of signal 242 is provided as signal 330 to the set point of primary air controller 62. The greater magnitude portion of signal 242 is provided as signal 332 as the set point of secondary air controller 64 as illustrated in FIG. 1. Flow transducer 342 in combination with a flow sensor 344 operably located in conduit means 22 provides an output signal 340 which is representative of the actual air flow rate in conduit means 22. Flow controller 62 is also provided with signal 340 and in response to signals 340 and 330 flow controller 62 provides an output signal 346 which is responsive to the difference between signals 330 and 340. Signal 346 is scaled so as to be representative of the position of control valve 44 required to maintain the actual flow represented by signal 340 substantially equal to the desired flow represented by signal 330. Signal 346 is provided from flow controller 62 to control valve 44 and control valve 44 is manipulated in response thereto.

In a similar manner signal 332 is provided from split-range computer block 244 as a set point signal for secondary air controller 64. Flow transducer 350 in combination with a flow sensor 352 operably located in conduit means 58 provides an output signal 354 which is representative of the actual air flow in conduit means 58. Signal 354 is provided as a process variable input to controller 64. In response to signals 332 and 354 controller 64 provides an output signal 356 which is responsive to the difference between signals 332 and 354. Signal 356 is scaled to be representative of the position of control valve 52 required to maintain the actual air flow rate in conduit means 58 represented by signal 354 substantially equal to the desired flow rate represented by set point signal 332. Signal 356 is provided from controller 64 to control valve 52 and control valve 52 is manipulated in response thereto.

Referring now to FIG. 4, signal 360 which is representative of the total theoretical air flow required for waste destruction based on measured fuel flow rates is calculated in computer block 358 in accordance with the following equation:

$$A_R = \sum_{1}^{2} M_i R_i$$

where
M=Measured fuel flow rate (lbs./hr.).
R=Air to fuel ratio,
i=Fuel index, i.e.,
1=conduit 40, signal 118.
2=conduit 41, signal 122.

Signal 360 is provided from computer block 358 as a first input to high select block 370.

In a similar manner signal 364 which is representative of the total afterburner air flow required for complete waste destruction in the afterburner based on commanded fuel flow rates for the afterburner is calculated in computer block 362 in accordance with the following equation:

$$A_{RC} = \sum_{1}^{2} C_i R_i$$

where C=Commanded afterburner fuel flow, signals 256 and 270 (lbs./hr.).

In response to signals 360 and 364 high select block 370 provides an output signal 366 which is representative of the highest flow rate represented by signals 360 and 364. Signal 366 is provided from high select block 370 as a first input to multiplying block 368. Signal 198 which is representative of the percent oxygen content of combustion gases exiting afrerburner 16 is provided as a process variable input to the oxygen controller 372. Signal 374 which is representative of the desired excess oxygen for the afterburner combustion gases is provided as a set point signal for the oxygen controller 372. Oxygen controller 372 provides an output signal 376 which is representative of the difference between signals 374 and 198, and which is scaled to be representative of an excess oxygen factor required to bias or trim the total theoretical air flow as represented by signal 366 so that the actual excess oxygen in the afterburner is substantially equal to the excess oxygen represented by set point signal 374. Thus the excess oxygen factor indicates the increase in the magnitude of signal 366 required to obtain the air flow for complete combustion of the waste fuel in afterburner 16. Signal 376 is provided from the oxygen controller 372 as a second input to multiplying block 368. Signal 376 is multiplied by signal 366 in multiplying block 368 to establish signal 378 which is representative of the desired air flow for the afterburner 16. Signal 378 is provided from multiplying block 368 as a set point input for flow controller 66 as illustrated in FIG. 1.

Flow transducer 320 in combination with flow sensor 322 which is operably located in conduit means 24 provides an output signal 324 which is representative of the actual air flow in conduit means 24. Signal 324 is provided from flow transducer 320 as the process variable input to flow controller 66. In response to signals 378 and 324 flow controller 66 provides an output signal 326 which is responsive to the difference between signals 378 and 324 and is scaled to be representative of the position of control valve 68 required to maintain the actual combustion air flow to the afterburner substantially equal to the desired air flow represented by signal 378. Signal 326 is provided from flow controller 66 to control valve 68 and control valve 68 is manipulated in response thereto.

In summary, since the combustion air is continuously manipulated in response to the larger air requirement as determined from signals responsive to the total measured fuel flow and the total commanded fuel flow, and the excess oxygen is maintained by a controller acting on the measured amount of the oxygen in the flue gas, the control system of the present invention will insure that the incinerator operates with sufficient air for complete combustion of the fuel supplied to the incinerator even when the fuel flow rate is changing.

The invention has been described in terms of the presently preferred embodiment as illustrated in FIGS. 1–4. Specific components which can be used in the practice of the invention as illustrated in FIG. 1 such as flow transducer 70, 72, 88, 90, 92, 320, 342, and 350; oxygen transducers 192 and 196; control valves 44, 46, 48, 50, 52, 54, 56 and 68; and flow controllers 62, 64, 66, 310, 312, and 314 are each well-know, commercially available control components such as are described at length in Perry's Chemical Engineers Handbook, 4th Edition, Chapter 22, McGraw-Hill. The controllers illustrated in FIGS. 3 and 4 as well as the calculation blocks and the select circuits illustrated in FIGS. 3 and 4 may be implemented by using a digital computer such as the OPTROL® DCS manufactured by Applied Automation, Inc., Bartlesville, Okla.

For reasons of brevity, conventional auxiliary equipment such as pumps, heat exchangers, additional measurement control devices, etc. have not been included in the above description as they play no part in the explanation of the invention.

While the invention has been described in terms of the presently preferred embodiment, reasonable modification and variations are possible by those skilled in the art and such modifications and variations are within the scope of the described invention and the appended claims.

That which is claimed is:

1. Apparatus comprising:

an incinerator having a combustion zone;

means for supplying a first waste fuel to said combustion zone and for burning said first waste fuel in said combustion zone;

means for supplying combustion air to said combustion zone, wherein said combustion air supports combustion of said first waste fuel;

means for establishing a first signal representative of the theoretical air flow required for combustion of said first waste fuel supplied to said combustion zone, wherein said first signal is responsive to the actual flow rate of said first waste fuel supplied to said combustion zone;

means for establishing a second signal representative of the theoretical air flow required for combustion of said first waste fuel supplied to said combustion zone, wherein said second signal is responsive to the commanded flow rate of said first waste fuel supplied to said combustion zone;

a first select means;

means for providing said first signal and said second signal to said first select means and for establishing a third signal which is equal to the one of said first signal and said second signal representative of the highest air flow rate for said combustion air supplied to said combustion zone;

means for establishing a fourth signal representative of a first excess oxygen factor, wherein said first excess oxygen factor indicates the necessary increase in the magnitude of said third signal to obtain the actual air flow required for complete combustion of said first waste fuel in said combustion zone;

means for changing the magnitude of said third signal based on said fourth signal to establish a fifth signal representative of the air flow required to said combustion zone for complete combustion of said first waste fuel supplied to said combustion zone; and means for manipulating the flow rate of said combustion air supplied to said combustion zone in response to said fifth signal.

2. Apparatus in accordance with claim 1 wherein said means for manipulating the flow rate of said combustion air in response to said fifth signal comprises:

a first burner associated with said combustion zone for burning liquid fuel, gaseous fuel and vaporous fuel;

means for supplying a primary air stream to said first burner;

means for supplying a secondary air stream to said combustion zone;

means for dividing said fifth signal into two portions to establish two control signals including a sixth signal representative of the lesser magnitude portion of said fifth signal, and a seventh signal representative of the greater magnitude portion of said fifth signal; and means for manipulating said primary air stream to said first burner in response to said sixth signal and for manipulating said secondary air stream to said combustion zone in response to said seventh signal.

3. Apparatus in accordance with claim 2 additionally comprising:

an afterburner for receiving combustion gases from said combustion zone;

a second burner associated with said afterburner for burning liquid fuel, gaseous fuel and vaporous fuel;

means for supplying said first waste fuel to said afterburner and for burning said first waste fuel in said afterburner;

means for supplying a primary air stream to said second burner;

means for establishing an eighth signal representative of the theoretical air flow required for combustion of said first waste fuel supplied to said second burner, wherein said eighth signal is responsive to the actual flow rate of said first waste fuel supplied to said second burner;

means for establishing a ninth signal representative of the theoretical air flow required for combustion of said first waste fuel supplied to said second burner, wherein said ninth signal is responsive to the commanded flow rate of said first waste fuel supplied to said second burner;

a second select means;

means for providing said eight signal and said ninth signal to said second select means and for establishing a tenth signal which is equal to the one of said eight signal and said ninth signal representative of the highest air flow rate for said combustion air supplied to said second burner;

means for establishing an eleventh signal representative of a second excess oxygen factor, wherein said second excess oxygen factor indicates the necessary increase in the magnitude of said tenth signal to obtain the actual air flow required for complete combustion of said first waste fuel in said afterburner;

means for changing the magnitude of said tenth signal based on said eleventh signal to establish a twelfth signal which is representative of the air flow required in said afterburner for complete combustion of said first waste fuel supplied to said afterburner; and means for manipulating the flow rate of said primary air stream supplied to said second burner in response to said twelfth signal.

4. Apparatus in accordance with claim 2 wherein said means for manipulating said primary air stream to said first burner in response to said sixth signal comprises:

a first control valve operably located so as to manipulate the flow rate of said primary air stream to said first burner;

means for establishing an eighth signal representative of the actual flow rate of said primary air to said first burner;

means for comparing said eighth signal and said sixth signal and for producing a ninth signal representative of the comparison, wherein said ninth signal is scaled so as to be representative of the position of said first control valve required to maintain the actual flow rate of said primary air to said first burner substantially equal to the desired flow rate represented by said sixth signal; and means for manipulating said first control valve in response to said ninth signal.

5. Apparatus in accordance with claim 4 wherein said means for manipulating said secondary air stream to said combustion zone in response to said seventh signal comprises:

a second control valve operably located so as to manipulate the flow rate of said secondary air stream to said combustion zone;

means for establishing a tenth signal representative of the actual flow rate of said secondary air stream supplied to said combustion zone;

means for comparing said tenth signal and said seventh signal and for producing an eleventh signal representative of the comparison, wherein said eleventh signal is scaled so as to be representative of the position of said second control valve required to maintain the actual flow rate of said secondary air stream to said combustion zone substantially equal to the desired flow rate represented by said seventh signal;

means for manipulating said second control valve in response to said eleventh signal.

6. Apparatus in accordance with claim 1 additionally comprising:

means for supplying an auxiliary fuel to said combustion zone and for burning said auxiliary fuel in said combustion zone;

means for supplying a second waste fuel to said combustion zone and for burning said second waste fuel in said combustion zone, wherein the theoretical air required for combustion of said second waste fuel is different from the theoretical air required for combustion of said first waste fuel; and means for analyzing said first and second waste fuel and said auxiliary fuel before supplying said fuels to said combustion zone to predetermine the theoretical air to fuel ratio for combustion of said first and second waste fuels and said auxiliary fuel.

7. Apparatus in accordance with claim 6 wherein said means for establishing said first signal comprises:

means for establishing a sixth signal representative of the actual flow rate of said first waste fuel;

means for establishing a seventh signal representative of the actual flow rate of said second waste fuel;

means for establishing an eighth signal representative of the actual flow rate of said auxiliary fuel;

means for establishing a ninth signal representative of the theoretical air to fuel ratio for said first waste fuel;

means for establishing a tenth signal representative of the theoretical air to fuel ratio for said second waste fuel;

means for establishing an eleventh signal representative of the theoretical air to fuel ratio for said auxiliary fuel;

means for multiplying said sixth signal by said ninth signal to establish a twelfth signal representative of the air flow required for combustion of said first waste fuel in said combustion zone;

means for multiplying said seventh signal by said tenth signal to establish a thirteenth signal representative of the air flow required for combustion of said second waste fuel in said combustion zone;

means for multiplying said eighth signal by said eleventh signal to establish a fourteenth signal representative of the air flow required for the combustion of said auxiliary fuel in said combustion zone; and means for summing said twelfth, said thirteenth and said fourteenth signals to establish said first signal.

8. Apparatus in accordance with claim 7 wherein said means for establishing said second signal comprises:

means for establishing a fifteenth signal representative of the commanded flow rate of said first waste fuel;

means for establishing a sixteenth signal representative of the commanded flow rate of said second waste fuel;

means for establishing a seventeenth signal representative of the commanded flow rate of said auxiliary fuel;

means for multiplying said fifteenth signal by said ninth signal to establish an eighteenth signal representative of the air flow required for combustion of said first waste fuel in said combustion zone;

means for multiplying said sixteenth signal by said tenth signal to establish a nineteenth signal representative of the air flow required for combustion of said second waste fuel in said combustion zone;

means for multiplying said seventeenth signal by said eleventh signal to establish a twentieth signal representative of the air flow required for combustion of said auxiliary fuel in said combustion zone; and means for summing said eighteenth signal, said nineteenth signal and said twentieth signal to establish said second signal.

9. Apparatus in accordance with claim 1 wherein said first waste fuel is a hazardous material to be destroyed.

10. Apparatus in accordance with claim 8 wherein said second waste fuel is a hazardous material to be destroyed and said auxiliary fuel is natural gas.

11. Apparatus comprising:

an incinerator having a combustion zone;

means for supplying a waste fuel to said combustion zone and for burning said first waste fuel in said combustion zone;

means for supplying an axuiliary fuel to said combustion zone and for burning said auxiliary fuel in said combustion zone;

means for supplying combustion air to said combustion zone, wherein said combustion air supports combustion of said waste fuel and said auxiliary fuel;

means for establishing a first signal wherein said first signal is an air limiting signal representative of a fraction of the total actual air flow in said combustion zone available for combustion of said waste fuel;

means for establishing a second signal representative of the theoretical air flow required for combustion of said waste fuel supplied to said combustion zone wherein said second signal is responsive to the commanded flow rate of said waste fuel;

means for establishing a third signal representative of the theoretical air flow required for combustion of said auxiliary fuel supplied to said combustion zone wherein said third signal is responsive to the commanded flow rate of said auxiliary fuel;

means for establishing a fourth signal representative of the theoretical air flow required for combustion of said waste fuel supplied to said combustion zone wherein said fourth signal is responsive to said first signal;

means for establishing a fifth signal representative of the theoretical air flow required for combustion of said auxiliary fuel supplied to said combustion zone, wherein said fifth signal is responsive to the actual flow rate of said auxiliary fuel supplied to said combustion zone;

means for establishing a sixth signal representative of the sum of said second signal and said third signal;

means for establishing a seventh signal representative of the sum of said fourth signal and said fifth signal;

a select means;

means for providing said sixth signal and said seventh signal to said select means and for establishing an eighth signal which is equal to the one of said sixth signal and said seventh signal representative of the highest air flow rate for said combustion air supplied to said combustion zone;

means for establishing a ninth signal representative of an excess oxygen factor, wherein said excess oxygen factor indicates the necessary increase in the magnitude of said eighth signal to obtain the actual air flow required for complete combustion of said waste fuel in said combustion zone;

means for changing the magnitude of said eighth signal based on said ninth signal to establish a tenth signal representative of the air flow required for complete combustion of said waste fuel and said auxiliary fuel supplied to said combustion zone; and means for manipulating the flow rate of said combustion air supplied to said combustion zone in response to said tenth signal.

12. A method for controlling an incineration process wherein a waste fuel and combustion air are supplied to the combustion zone of an incinerator said method comprising the steps of:

establishing a first signal representative of the theoretical air flow required for combustion of said first waste fuel supplied to said combustion zone, wherein said first signal is responsive to the actual flow rate of said first waste fuel supplied to said combustion zone;

establishing a second signal representative of the theoretical air flow required for combustion of said first waste fuel supplied to said combustion zone, wherein said second signal is responsive to the commanded flow rate of said first waste fuel supplied to said combustion zone;

establishing a third signal which is equal to the one of said first signal and said second signal representative of the highest air flow rate for said combustion air supplied to said combustion zone;

establishing a fourth signal representative of a first excess oxygen factor, wherein said first excess oxygen factor indicates the necessary increase in the magnitude of said third signal to obtain the actual air flow required for complete combustion of said first waste fuel in said combustion zone;

changing the magnitude of said third signal based on said fourth signal to establish a fifth signal representative of the air flow required to said combustion zone for complete combustion of said first waste fuel supplied to said combustion zone; and manipulating the flow rate of said combustion air supplied to said combustion zone in response to said fifth signal.

13. A method in accordance with claim 12 wherein said waste fuel and a primary air stream are supplied to a first burner associated with said combustion zone and a secondary air stream is supplied to said combustion zone and wherein said step for manipulating the flow rate of said combustion air in response to said fifth signal comprises:

dividing said fifth signal into two portions to establish two control signals including a sixth signal representative of the lesser magnitude portion of said fifth signal, and a seventh signal representative of the greater magnitude portion of said fifth signal; and manipulating said primary air stream to said first burner in response to said sixth signal and manipulating said secondary air stream to said combustion zone in response to said seventh signal.

14. A method in accordance with claim 13 wherein the combustion gases from said combustion zone are provided to an afterburner and said first waste fuel and a primary air stream are provided to a second burner associated with said afterburner, said method additionally comprising the steps of:

establishing an eighth signal representative of the theoretical air flow required for combustion of said first waste fuel supplied to said second burner, wherein said eighth signal is responsive to the actual flow rate of said first waste fuel supplied to said second burner;

establishing a ninth signal representative of the theoretical air flow required for combustion of said first waste fuel supplied to said second burner, wherein said ninth signal is responsive to the commanded flow rate of said first waste fuel supplied to said second burner;

establishing a tenth signal which is equal to the one of said eighth signal and said ninth signal representative of the highest air flow rate for said combustion air supplied to said second burner;

establishing an eleventh signal representative of a second excess oxygen factor, wherein said second excess oxygen factor indicates the necessary increase in the magnitude of said tenth signal to obtain the air flow required for complete combustion of said first waste fuel in said afterburner;

changing the magnitude of said tenth signal based on said eleventh signal to establish a twelfth signal which is representative of the air flow required in said afterburner for complete combustion of said first waste fuel supplied to said afterburner; and manipulating the flow rate of said primary air stream supplied to said second burner in response to said twelfth signal.

15. A method in accordance with claim 13 wherein a first control valve is operably located so as to manipulate the flow rate of said primary air stream to said first burner and wherein said step for manipulating said primary air stream in response to said sixth signal comprises:

establishing an eighth signal representative of the actual flow rate of said primary air to said first burner;

comparing said eighth signal and said sixth signal and producing a ninth signal representative of the comparison, wherein said ninth signal is scaled so as to be representative of the position of said first control valve required to maintain the actual flow rate of said primary air to said first burner substantially equal to the desired flow rate represented by said sixth signal; and manipulating said first control valve in response to said ninth signal.

16. A method in accordance with claim 15 wherein a second control valve is operably located so as to manipulate the flow rate of said secondary air stream to said combustion zone and wherein said step for manipulating said secondary air stream to said combustion zone in response to said seventh signal comprises:

establishing a tenth signal representative of the actual flow rate of said secondary air stream supplied to said combustion zone;

comparing said tenth signal and said seventh signal and producing an eleventh signal representative of the comparison, wherein said eleventh signal is scaled so as to be representative of the position of said second control valve required to maintain the actual flow rate of said secondary air stream to said combustion zone substantially equal to the desired flow rate represented by said seventh signal;

manipulating said second control valve in response to said eleventh signal.

17. A method in accordance with claim 12 wherein an auxiliary fuel and a second waste fuel are additionally supplied to said combustion zone, and wherein said first waste fuel, said second waste fuel and said auxiliary fuel are preanalyzed to determine the theoretical air to fuel ratio for combustion of said first and second waste fuels and said auxiliary fuel, and wherein said step of establishing said first signal comprises:

establishing a sixth signal representative of the actual flow establishing a seventh signal representative of the actual flow rate of said second waste fuel;

establishing an eighth signal representative of the actual flow rate of said auxiliary fuel;

establishing a ninth signal representative of the theoretical air to fuel ratio for said first waste fuel;

establishing a tenth signal representative of the theoretical air to fuel ratio of said second waste fuel;

establishing an eleventh signal representative of the theoretical air to fuel ratio of said auxiliary fuel;

multiplying said sixth signal by said ninth signal to establish a twelfth signal representative of the air flow required for combustion of said first waste fuel in said combustion zone;

multiplying said seventh signal by said tenth signal to establish a thirteenth signal representative of the air flow required for combustion of said second waste fuel in said combustion zone;

multiplying said eighth signal by said eleventh signal to establish a fourteenth signal representative of the air flow required for the combustion of said auxiliary fuel in said combustion zone; and summing said twelfth, said thirteenth, and said fourteenth signals to establish said first signal.

18. A method in accordance with claim 17 wherein said step for establishing said second signal comprises:

establishing a fifteenth signal representative of the commanded flow rate of said first waste fuel;

establishing a sixteenth signal representative of the commanded flow rate of said second waste fuel;

establishing a seventeenth signal representative of the commanded flow rate of said auxiliary fuel;

multiplying said fifteenth signal by said ninth signal to establish an eighteenth signal representative of the air flow required for combustion of said first waste fuel in said combustion zone;

multiplying said sixteenth signal by said tenth signal to establish a nineteenth signal representative of the air flow required for combustion of said second waste fuel in said combustion zone;

multiplying said seventeenth signal by said eleventh signal to establish a twentieth signal representative of the air flow required for combustion of said auxiliary fuel in said combustion zone; and summing said eighteenth signal, said nineteenth signal and said twentieth signal to establish said second signal.

19. A method in accordance with claim 12 wherein said first waste fuel is a hazardous material to be destroyed.

20. A method in accordance with claim 18 wherein said second waste fuel is a hazardous material to be destroyed and said auxiliary fuel is natural gas.

* * * * *

UNITED STATES PATENT AND TRADEMARK OFFICE

CERTIFICATE OF CORRECTION

PATENT NO. : 4,742,783

DATED : 05-10-88

INVENTOR(S) : Ronald J. LaSpisa et al.

It is certified that error appears in the above-identified patent and that said Letters Patent is hereby corrected as shown below:

In Claim 3, Column 12, Line 27 after "providing said", please delete "eight" and insert ---eighth---, and in Line 30, at the beginning of the line, please delete "eight" and insert ---eighth---.

In Claim 17, Column 17, Line 26, following "flow", please insert ---rate of said first waste fuel;---.

Signed and Sealed this

Sixteenth Day of May, 1989

*Attest:*

DONALD J. QUIGG

*Attesting Officer*

*Commissioner of Patents and Trademarks*